United States Patent [19]

Greene

[11] Patent Number: 4,928,716

[45] Date of Patent: May 29, 1990

[54] PORTABLE HAIR TRIMMING DEVICE

[76] Inventor: Freddie W. Greene, 15 Brinton Ave., Trenton, N.J. 08618

[21] Appl. No.: 396,064

[22] Filed: Aug. 21, 1989

[51] Int. Cl.[5] ..... A45D 7/02

[52] U.S. Cl. ..... 132/212; 132/213; 132/213.1; 132/215; 30/295; 30/30

[58] Field of Search ..... 132/75.3, 75.4, 76.2, 132/148, 149, 212, 213, 213.1, 215; 30/29.5, 30

[56] References Cited

U.S. PATENT DOCUMENTS

| | | | |
|---|---|---|---|
| D. 197,588 | 2/1964 | Maion | D28/25 |
| D. 211,443 | 6/1968 | Tin | D28/52 |
| 881,125 | 3/1908 | Holmquist | 132/75.4 |
| 1,969,100 | 8/1934 | Segal | 132/76.2 |
| 2,262,315 | 11/1941 | Davies | 39/29.5 |
| 2,568,368 | 9/1951 | Sayer et al. | 30/30 |
| 2,569,344 | 9/1951 | Shaeffer | 30/30 |
| 2,575,652 | 11/1951 | Bovee | 132/75.4 |
| 2,858,835 | 11/1958 | Parziale | 132/213.1 |
| 2,972,187 | 2/1961 | Gore | 30/30 |
| 3,238,616 | 3/1966 | Eweson | 30/30 |
| 3,299,507 | 1/1967 | Mistretta | 30/29.5 |
| 3,536,080 | 10/1970 | Player et al. | 132/213.1 |
| 3,805,381 | 4/1974 | Broussard, Sr. | 132/75.4 |
| 4,029,112 | 6/1977 | Boose | 132/315 |
| 4,162,574 | 7/1979 | Johnston | 30/29.5 |
| 4,663,841 | 5/1987 | Custer | 30/30 |
| 4,709,475 | 12/1987 | Phung | 132/76.2 |

*Primary Examiner*—John J. Wilson
*Assistant Examiner*—Frank A. LaViola, Jr.
*Attorney, Agent, or Firm*—Jerry T. Kearns

[57] ABSTRACT

A portable hair trimming device for personal grooming operations includes a thin triangular housing having a hollow interior portion. An open slotted portion is formed in one side wall of the housing and a trimming implement has one end pivotally mounted adjacent an apex of the housing and is mounted for movement through the open slotted side wall into and out of the hollow interior housing portion. The trimming implement has a first side edge provided with a moustache comb and an opposite side edge provided with a trimming razor. A double-edged razor blade is mounted in a reversible manner in the trimming razor. A cylindrical nose hair trimmer is mounted in a holder on one side wall of the housing. A shallow triangular receptacle having a removable cover is provided on one face of the housing for storing a quantity of moustache wax.

13 Claims, 3 Drawing Sheets

PORTABLE HAIR TRIMMING DEVICE

BACKGROUND OF THE INVENTION

1. Field of the Invention

The present invention relates to hair trimming devices, and more particularly pertains to a portable hair trimmind device for use by individuals in performing personal grooming operations. Various types of hair trimming devices are known in the prior art, but these conventional devices are relatively bulky and do not provide a plurality of required personal grooming implements in a single small housing which is easily carried in the pocket of an individual. In order to overcome these problems, the present invention provides an extremely small and easily portable trimming device including a plurality of different implements for performing various personal grooming operations.

2. Description of the Prior Art

Various types of hair trimming devices are known in the prior art. A typical example of such a hair trimming device is to be found in U.S. Pat. No. 2,858,835, which issued to J. Parziale on Nov. 4, 1958. This patent discloses a hair trimming devive having a plurality of teeth extending in side by side spaced relation and tapered cintinuously in depth. U.S. Pat. No. 2,972,187, which issued to T. Gore on Feb. 21, 1961, discloses a hair thinning implement including a double-edge razor blade mounted between opposed clamping elements. U.S. Design Patent No. 197,588, which issued to A. Macon on Feb. 25, 1964, discloses a combined hair shaper and comb provided on opposite longitudinal side edges of a head portion secured to an elongated handle. U.S. Pat. No. 3,238,616, which issued to E. Eweson on Mar. 8, 1966, discloses a hair trimming implement which utilizes a replaceable double-edged razor blade. U.S. Design Patent No. 211,443, which issued to N. Tin on Jun. 11, 1968, discloses a combined comb and thinning razor having a thinning razor mounted on a first longitudinal side edge and a comb mounted on a second opposite longitudinal side edge.

While the above mentioned devices are directed to hair trimming devices, none of these devices disclose a portable hair trimming device including a thin triangular housing mounting a pivotal trimming implement for movement between open and closed positions. Additionally, none of the aforementioned prior art devices include a single compact housing including a moustache comb, a trimming razor, a nose hair trimmer, and a supply of moustache wax. Inasmuch as the art is relatively crowded with respect to these various types of hair trimming devices, it can be appreciated that there is a continuing need for and interest in improvements to such hair trimming devices, and in this respect, the present invention addresses this need and interest.

SUMMARY OF THE INVENTION

In view of the foregoing disadvantages inherent in the known types of hair trimming devices now present in the prior art, the present invention provides an improved portable hair trimming device. As such, the general purpose of the present invention, which will be described subsequently in greater detail, is to provide a new and improved portable hair trimming device which has all the advantage of the prior art hair trimming devices and none of the disadvantages.

To attain this, a representative embodiment of the concepts of the present invention is illustrated in the drawings and makes use of a portable hair trimming device, for personal grooming operations, which includes a thin triangular housing having a hollow interior portion. An open slotted portion is formed in one side wall of the housing and a trimming implement has one end pivotally mounted adjacent an apex of the housing and is mounted for movement through the open slotted side wall into and outof the hollow interior housing portion. The trimming implement has a first side edge provided with a moustache comb and an opposite side edge provide with a trimming razor. A double-edge razor blade is mounted in a reversible manner in the trimming razor. A cylindrical nose hair trimmer is mounted in a holder on one side wall of the housing. A shallow triangular receptacle having a removable cover is provided on one face of the housing for storing a quantity of moustache wax.

There has thus been outlined, rather broadly, the more important features of the invention in order that the detailed description thereof that follows may be better understood, and in order that the present contribution to the art may be betteer appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable hair trimming device which has all the advantages of the prior art hair trimming devices and none of the disadvantages.

It is another object of the present invention to provide a new and improved portable hair trimming device which may be easily and efficiently manufactured and marketed.

It is a further object of the present invention to provide a new and improved portable hair trimming device which is of a durable and reliable construction.

An even further object of the present invention is to provide a new and improved portable hair trimming device which is susceptible of a low cost of manufacture with regard to both materials and labor, and which accordingly is then susceptible of low prices of sale to the consuming public, thereby making such hair trimming devices economically available to the buying public.

Still yet another object of the present invention is to provide a new and improved portable hair trimming device which provides in the apparatuses and methods of the prior art some of the advantages thereof, while simultaneously overcoming some of the disadvantages normally associated therewith.

Still another object of the present invention is to provide a new and improved portable hair trimming device including a plurality of implements for performing a variety of different personal grooming operations in a single compact housing.

Yet another object of the present invention is to provide a new and improved portable hair trimming device which allows individuals having a moustache to conveniently comb, trim and wax their moustache to achieve an attractive personal appearance.

Even still another object of the present invention is to provide a new and improved portable hair trimming device including a thin triangular housing having a trimming implement pivotally mounted for movement into and out of a hollow interior portion of the housing.

These together with their objects of the invention, along with the various features of novelty which characterize the invention, are pointed out with particularity in the claims annexed to and forming a part of this disclosure. For a better understanding of the invetnion, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
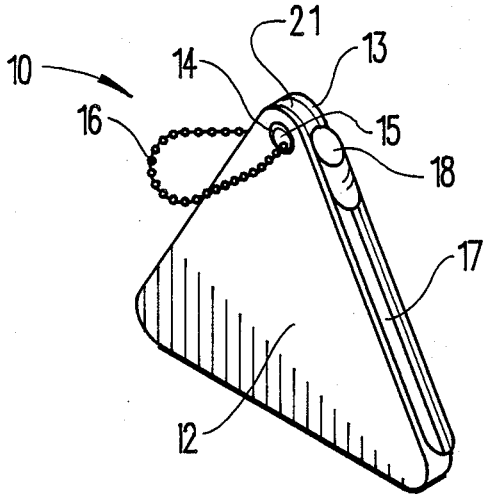
FIG. 1 is a back side perspective view of the hair trimming device of the present invention.

With reference now to the drawings, and in particular to FIG. 1 thereof, a new and improved portable hair trimming device embodying the principles and concepts of the present invention and generally designated by the reference numeral 10 will be described.

Figure 2:
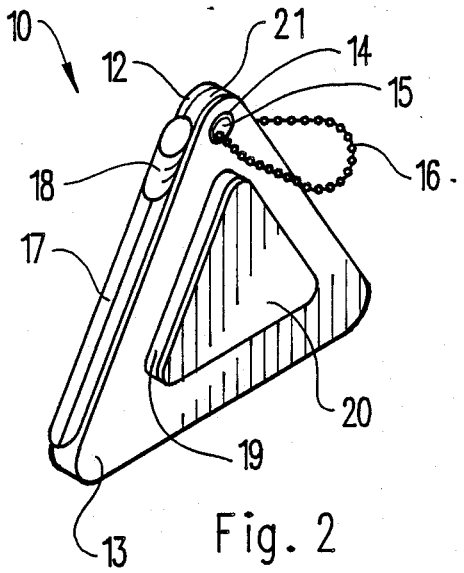
FIG. 2 is a front side perspective view of the hair trimming device of FIG. 1.

More specifically, it will be noted that the first embodiment 10 of the invention includes a thin, generally triangular housing having a back triangular face 12 and a front triangular face 13. A trimming implement 21 is mounted by a rivet 14 adjacent one apex of the triangular housing for movement into and out of a hollow interior portion of the housing. The rivet 14 has a circular aperture 15 through which a ball-type chain 16 is secured. The chain 16 may be utilized for attachment to a variety of items such as keys. A nose hair trimmer having a knob portion 18 is frictionally engaged in a generally cylindrical holder 17 provided on one side wall of the triangular housing. The generally opposite side wall has an open slotted portion through which the trimming implement 21 is mounted for movement to an open operative position. FIG. 2 illustrates a front side perspective view of the trimming device 10 which illustrates a shallow triangular receptacle 19 formed on the front face 13 and including a removable triangular snap-on type cap 20. A small replaceable tin of moustache wax is stored within the receptacle 19.

Figure 3:
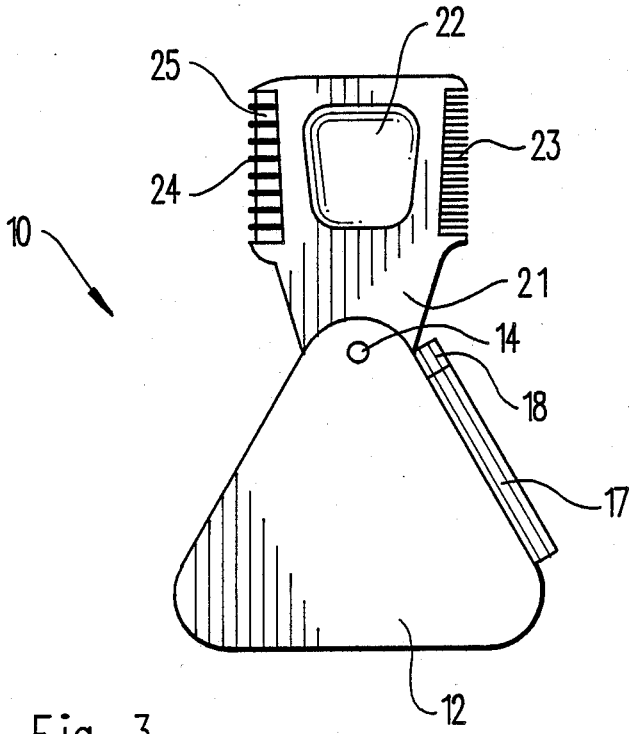
FIG. 3 is a back side view illustrating the hair trimming device of FIG. 1, with the trimming implement in an open operative position.

FIG. 3 illustrates the trimming implement 21 pivoted to an open operative position. The top end of the nose hair trimmer knob portion 18 forms a stop for limiting the pivoting movement of the implement 21. An indentation 22 is formed in one face of the trimming implement 21 and is adapted for the insertion of the thumb or finger of an individual to facilitate manual manipulation of the trimming implement 21. A moustache comb 23 is provided on a first longitudinal side edge of the trimming implement 21 and a trimming razor blade 25 is inserted through a plurality of slotted, laterally extending comb-like projections 24 spaced along an opposite side edge of the trimming implement 21.

Figure 4:
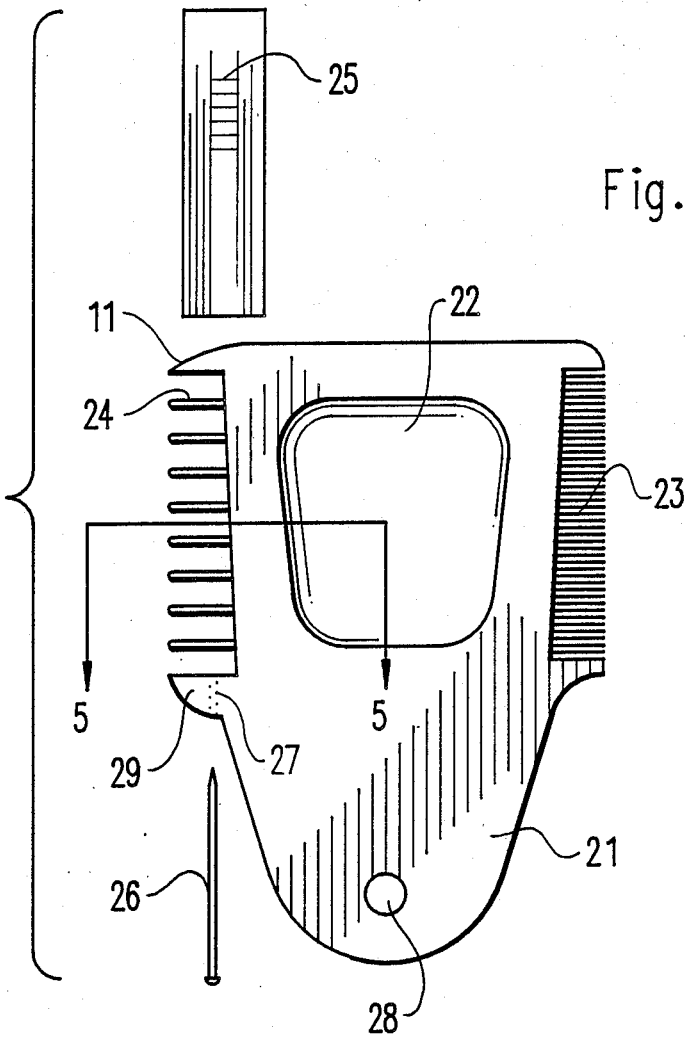
FIG. 4 is an exploded side elevational view illustrating the constructional details of the hair trimming implememt.

FIG. 4 illustrates the double-edge razor blade 25 removed from engagement with the aligned slotted projections 24. An end tab potion 11 of the trimming implement 21 is provided with an end slot 30 dimensioned to allow insertion of the double-edged razor blade 25. Each of the comb-like projections 24 is provided with a similar, aligned slot to allow insertion of the blade 25. A laterally extending mounting tab 29 is adapted for abutment with a planar inner end wall of the razor blade 25. An axially extending circular bore or aperture 27 is formed through the mounting tab 29 for alignment with one of a pair of parallel axial bores formed through the blade 25. The retaining pin 26 is inserted through the aligned bores in the tab 29 and the blade 25 to secure the blade 25 in a reversible fashion on the trimming implement 21. The trimming implement 21 includes an inner end tapered to a reduced width radiused portion provided with a circular aperture 28 for receiving the pivotal mounting rivet 14 (FIG. 1).

Figure 5:
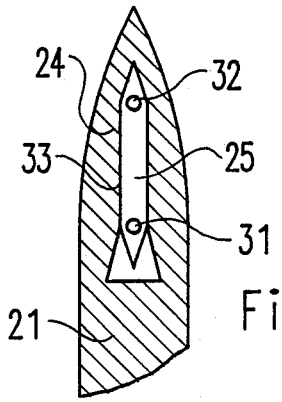
FIG. 5 is a cross sectional detail view, taken along line 5—5 of FIG. 4.

FIG. 5 is a cross sectional view which illustrates the blade 25 inserteed through the aligned slots 33 formed in the comb-like projections 24. The spaced circular bores 31 and 32 are formed through the blade 25, as previously described. In the illustrated orientation, the inner bore 31 will receive the retaining pin 26 shown in FIG. 4.

Figure 6:
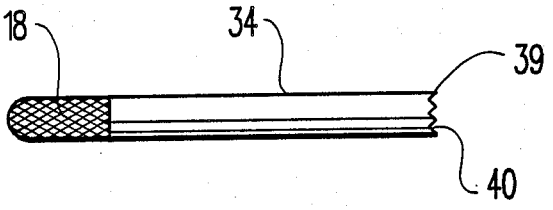
FIG. 6 is a side view illustrating the nose hair trimmer of the portable hair trimming device of the present invention.

FIG. 6 illustrates the nose hair trimmer which includes an outer tube 34 provided with a circular array of saw-tooth teeth 39 on a distal end portion thereof. A coaxial interior tube includes a plurality of similar, saw-tooth teeth 40 which extend in a circular array and are disposed in axial alignment with the teeth 39 on the other tube 34. The knob porition 18 is secured to the inner tube and the outer tube 34 is grasped to allow relative rotation of the inner and outer tubes to provide a shearing action for nose hair received between the teeth 39 and 40.

Figure 7:
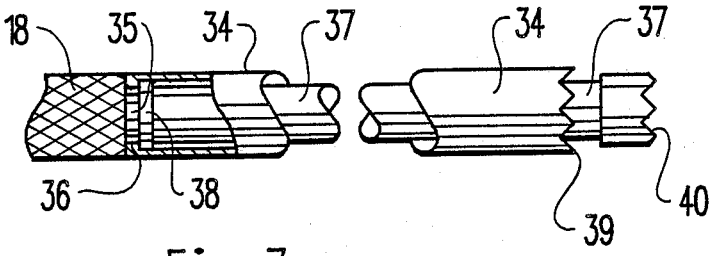
FIG. 7 is a detail view, partially cut away, further illustrating the construction of the nose hair trimmer of FIG. 6.

FIG. 7 is a detail view, partially cut away, further illustrating the constructional features of the nose hair trimmer. The inner tube 37 is of a smaller diameter than the outer tube 34 and is received in coaxial relation therein. The cutting teeth portion 40 of the inner tube 37 is illustrated in an axially spaced position from the cutting teeth 39 of the outer tube 34, for illustration purposes only. In the actual construction, the teeth 39 and 40 are disposed in axial alignment as illustrated in FIG. 6. The outer tube 34 includes a radially extending circular ledge 36 which receives a reduced diameter neck portion 35 of the inner tube 37. A radially extending flange 38 on the inner tube 37 restrains the inner tube 37 from axial movement with respect to the outer tube 34. A knob 18 is engaged, for example, by a threaded connection, on the upper end of the reduced neck portion 35 of the inner tube 37. As may now be understood, the outer tube 34 and inner tube 37 may be relatively rotated by an individual grasping the outer tube 34 in one hand and grasping and rotating the knob 18 in the other hand. This provides a shearing action between the cutting teeth 39 and 40.

Figure 8:
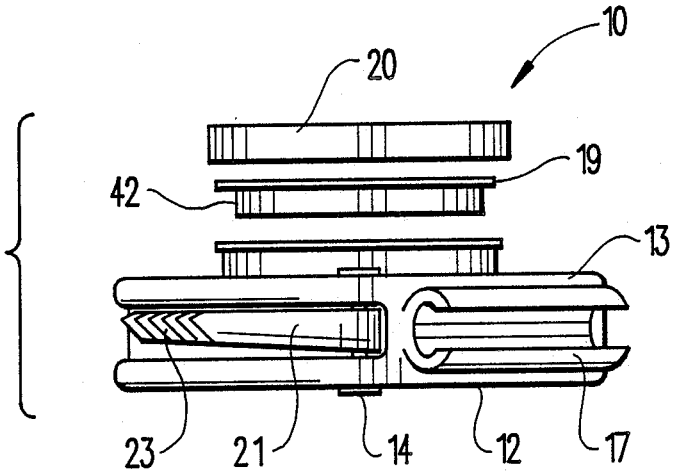
FIG. 8 is an exploded end view illustrating the receptacle for storing a quantity of moustache wax on the hair trimmer of the present invention.

FIG. 8 is an exploded end view which illustrates a replaceable tin 42 which contains a quantity of moustaches wax. The tin 42 is of a shallow triangular configuration and is dimensioned for insertion within the triangular receptacle 19 secured on the front face 13 of the trimming device 10. The removable cap 20 secures the tin 42 within the receptacle 19. The cylindrical holder 17 has an open slotted construction dimensioned for snap-type frictional engagement with the cylindrical nose hair trimming device illustrated in FIG. 6.

As may now be understood, the present invention provides a single integral unit which is of a small size, is easily transportable and allows an individual to conveniently perform a variety of different personal grooming operations.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illutrated in the drawins and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable hair trimming device, comprising:

a housing having a pair of opposite faces separated by a hollow interior portion and connected by a plurality of side walls;

an open slotted portion formed in one of said side walls of said housing:

a trimming implement having one end pivotally mounted on said housing, said trimming implement mounted for movement into and out of said hollow interior portion;

a moustache combe formed on a first side edge of said trimming implement;

a trimming razor on a second side edge of said trimming implement, said trimming razor including:

a plurality of laterally extending, longitudinally spaced comb-like projections on said trimming implement;

said projections having aligned slots;

a double-edged razor blade frictionally engaged in said slots and extending between said projections;

a pair of parallel axially extending bores in said razor blade;

a laterally extending mounting tab on said trimming implement and in abutment with an inner end wall of said razor blade;

an aperture formed through said tab in axial alignment with one of said parallel axial bores in said razor blade; and a retaining pin removably received through said aligned mounting tab aperture and said axial razor blade bore securing said razor blade in a reversible manner in said trimming implement.

2. The portable hair trimming device of claim 1, wherein said housing has a generally triangular configuration and said trimming implement is pivotally mounted adjacent an apex of said housing.

3. The portable hair trimming device of claim 2, further comprising a triangular shallow receptacle on one face of said housing storing a quantity of moustache wax and closed by a removable cap.

4. The portable hair trimming device of claim 1, further comprising a shallow receptacle on one face of said housing storing a quantity of moustache wax and closed by a removable cap.

5. The portable hair trimming device of claim 1, further comprising:

a generally cylindrical holder on one side wall of said housing; and a cylindrical nose hair trimmer removably received in said holder.

6. The portable hair trimmind device of claim 5, wherein said nose hair trimmer comprises:

a pair of relatively rotatable tubes mounted in coaxial relation;

said tubes having axially aligned annular cutting end portions each provided with a circular array of saw-tooth cutting teeth; and a knob secured to an inner one of said coaxial tubes for relatively rotating said annular end cutting portions.

7. The portable hair trimming device of claim 1, further comprinsing an indentation formed in said trimming implement to facilitate manual manipulation of said trimming implement.

8. A portable hair trimming device, comprising:

a thin, generally triangular housing having a pair of opposite faces separated by a hollow interior portion and connected by a plurality of side walls;

an open slotted portion formed in one of said side walls of said housing;

a trimming implement having one end pivotally mounted adjacent an apex of said housing, said trimming implement mounted for movement into and out of said hollow interior portion;

a moustache comb formed on a first side edge of said trimming implement;

a trimming razor on a second side edge of said trimming implement, opposite said comb, said trimming razor including:

a plurality of laterally extending, longitudinally spaced comb-like projections on said trimming implement;

said projections having aligned slots;

a double-edge razor blade frictionally engaged in said slots and extending between said projections;

a pair of parallel axially extending bores in said razor blade;

a laterally extending mounting tab on said trimming implement and in abutment with an inner end wall of said razor blade;

an apperture formed through said tab in axial alignment with one of said parallel axial bores in said razor blade; and a retaining pin removably received through said aligned mounting tab aperture and said axial razor blade bore securing said razor blade in a reversible manner in said trimming implement.

9. The portable hair trimming device of claim 8, further comprising a triangular shallow receptacle one on face of said housing storing a quantity of moustache wax and closed by a removable cover.

10. The portable hair trimming device of claim 8, further comprising:

a generally cylindrical holder on a side wall of said housing; and a cylindrical nose hair trimmer removably received in said holder.

11. The portable hair trimming device of claim 10, wherein said nose hair trimmer comprises:

a pair of relatively rotatable tubes mounted in coaxial relation;

said tubes having axially aligned annular cutting end portions each provided with a circular array of saw-tooth cutting teeth; and a knob secured to an inner one of said coaxial tubes for relatively rotating said annular end cutting portions.

12. The portable hair trimming device of claim 8, further comprising an indentation formed in said trimming implement to facilitate manual manipulation of said trimming implement.

13. A portable hair trimming device, comprising:

a thin generally triangular housing having a pair of opposite faces separated by a hollow interior portion and connected by a plurality of side walls;

an open slotted portion formed in one side wall of said housing;

a trimming implement having one end pivotally mounted adjacent an apex of said housing, said trimming implement mounted for movement into and out of said hollow interior portion;

a moustache comb formed on a first side edge of said trimming implement;

a trimming razor on a second side edge of said trimming implement, opposite said comb, said trimming razor including a plurality of laterally extending, longitudinally spaced comb-like projections, said projections having aligned slots;

a double-edge razor blade frictionally engaged in said slots and extending between said projections, said razor blades having a pair of parallel axially extending bores;

a laterally extending mounting tab on said trimming implement and in abutment with an inner end wall of said razor blade;

an aperture formed through said tab in axial alignment with one of said parallel axial bores in said razor blade;

a retaining pin removably received through said aligned mounting tab aperture and said axial razor blade bore securing said razor blade in a reversible manner in said trimming implement;

an indentation formed in said trimming implement to facilitate manual manipulation of said trimming implement;

a generally cylindrical slotted holder on a side wall of said housing;

a cylindrical nose hair trimmer removably received in frictional engagement with said holder;

said nose hair trimmer having a pair of relatively rotatable tubes mounted in coaxial relation, said tubes having axially aligned annular cutting end portions each provided with a circular array of saw-tooth cutting teeth;

a knob secured to an inner one of said coaxial tubes for relatively rotating said coaxial annular end cutting portions;

a triangular shallow receptacle on one face of said housing storing a quantity of moustache wax; and a removable cap on said receptacle.

* * * * *